US006669327B1

(12) United States Patent
Harper

(10) Patent No.: US 6,669,327 B1
(45) Date of Patent: Dec. 30, 2003

(54) INK SOLVENT DELIVERY APPARATUS

(75) Inventor: Kit L. Harper, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/164,835

(22) Filed: Jun. 7, 2002

(51) Int. Cl.[7] ..... B41J 2/165
(52) U.S. Cl. ..... 347/28
(58) Field of Search ..... 347/28, 20, 22; 15/3.12, 300.1, 318, 321, 320, 322, 104.03; 400/701

(56) References Cited

U.S. PATENT DOCUMENTS 6,145,953 A 11/2000 Medin
6,224,186 B1 5/2001 Johnson et al.
6,460,980 B1 * 10/2002 Hegedus et al.

* cited by examiner

*Primary Examiner*—Raquel Yvette Gordon

(57) ABSTRACT

An apparatus for delivering ink solvent to a printhead in a printing device is provided, the apparatus including a reservoir structure configured to hold ink solvent, a dispensing structure configured to dispense ink solvent drawn from the reservoir structure, and elongate conveyance structure fluidly connecting the reservoir structure to the dispensing structure, and having along its length a surface-energy characteristic which conveys a flowable continuum of ink solvent to the dispensing structure at least partially via surface-energy phenomena.

32 Claims, 6 Drawing Sheets

INK SOLVENT DELIVERY APPARATUS

BACKGROUND OF THE INVENTION

Much activity involved in improving printhead reliability in ink-utilizing printers has involved structure and methodology for cleaning and removing unwanted substances from printheads—chiefly dealing with the removal of ink deposits which have formed adjacent the exposed outer surfaces of printheads. It is typical, for example, for a printhead, once it has been returned to the servicing station in a printer, to be addressed by a contacting cleaning wiper which is formed of a flexible, resilient material that has been wetted with an appropriate ink solvent drawn from a solvent-dispensing system of such solvent in preparation for a printhead-cleaning operation.

It is desirable in this setting that the system for delivering fresh solvent for use by such a wiper (or cleaner) operate as efficiently and simply as possible, with minimal to no appreciable waste of solvent liquid, and under the control of supply and dispensing structure which is very reliable, and which occupies a minimum amount of space in a printer.

In this environment, different porous materials may be employed as parts of the structure which handles and delivers ink solvent. One such material typically acts as a part of a supply reservoir for ink solvent. Another material may be employed as a wettable dispensing pad that can be contacted by a cleaning wiper to deliver to that wiper an appropriate quantity of solvent for use by the wiper in a printhead-cleaning operation.

SUMMARY OF THE INVENTION

An apparatus for delivering ink solvent to a printhead in a printing device is provided, the apparatus including a reservoir structure configured to hold ink solvent, a dispensing structure configured to dispense ink solvent drawn from the reservoir structure, and elongate conveyance structure fluidly connecting the reservoir structure to the dispensing structure, and having along its length a surface-energy characteristic which conveys a flowable continuum of ink solvent to the dispensing structure at least partially via surface-energy phenomena.

DETAILED DESCRIPTION OF THE INVENTION

Figure 1:
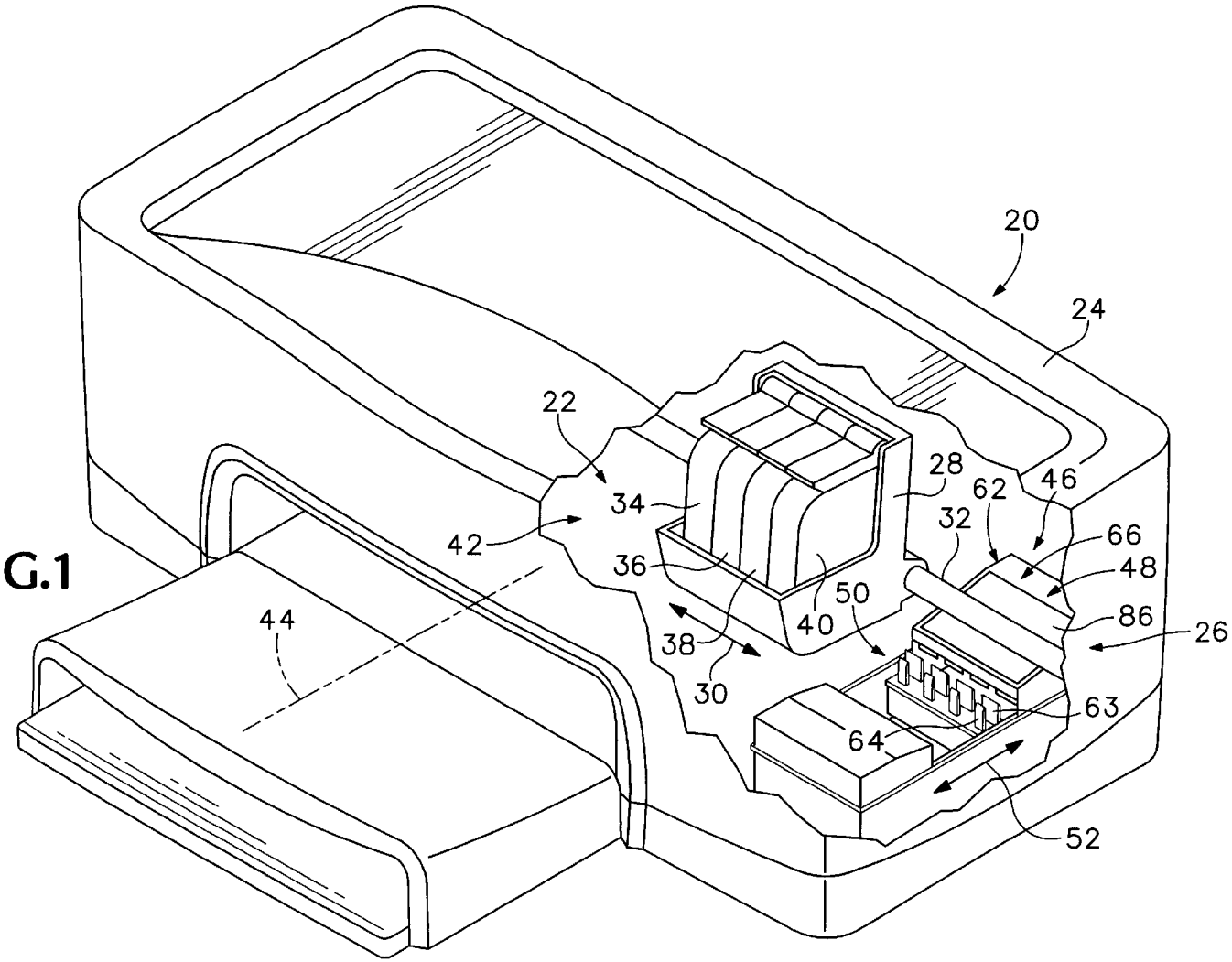
FIG. 1 is an isometric view of a printing device with portions broken away to reveal details of internal structure including ink solvent delivery apparatus in accordance with an embodiment of the present invention.
Figure 2:
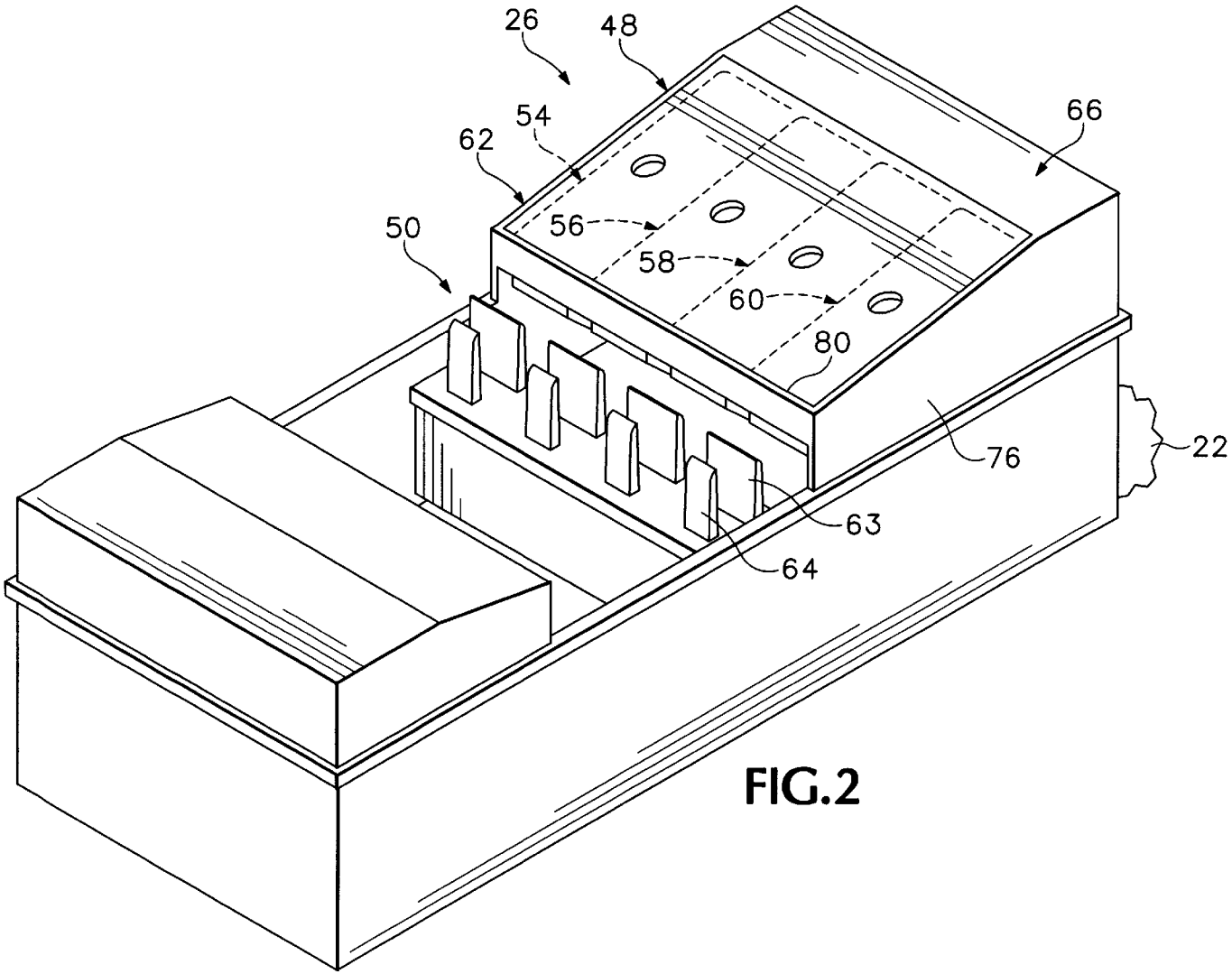
FIG. 2 is a larger-scale, isolated, isometric view of the solvent delivery apparatus depicted in FIG. 1.
Figure 3:
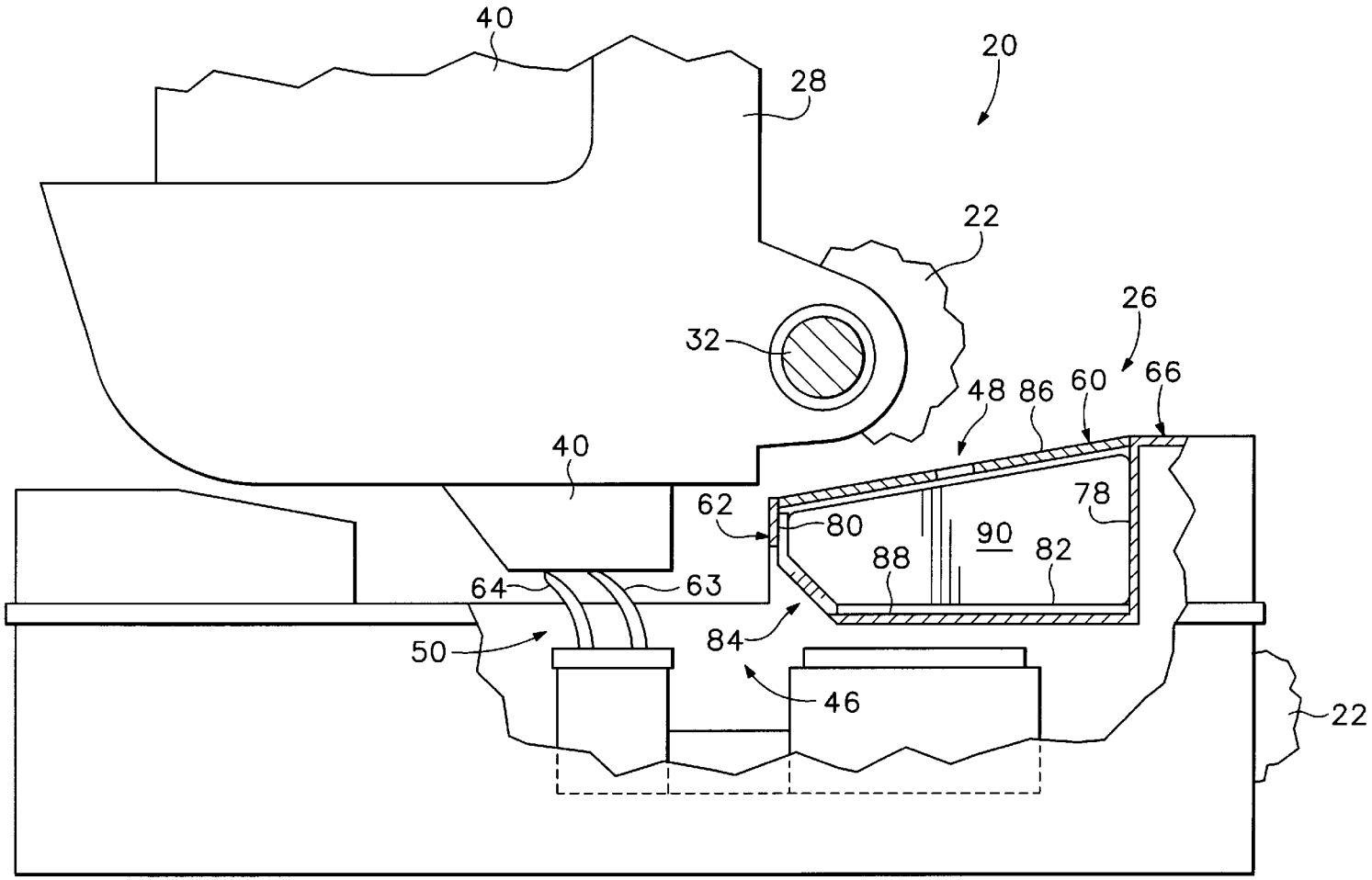
FIG. 3 is an even larger-scale, fragmentary side elevation view illustrating the ink solvent delivery apparatus of FIG. 2 during cleaning of a printhead in a printing device such as that shown in FIG. 1.

Turning now to the drawings, and referring first to FIG. 1, indicated generally at 20 is a printer, also referred to herein as a printing device, which incorporates and employs an ink solvent delivery apparatus as described further herein. Printer 20 is an inkjet printer, and while demonstrating just one of many different specific constructions and configurations of printing devices, nevertheless functions well to illustrate the incorporation and utility of the present ink solvent delivery apparatus.

Accordingly, printer 20 includes a frame 22 surrounded by a housing 24 which has been broken open, as seen in FIG. 1, to indicate the presence in this printer of a system or apparatus generally shown at 26 which is constructed, and which operates, in accordance with the present invention.

Included also in printer 20 is a printhead carriage 28 which is appropriately mounted for reciprocation, generally as indicated by double-ended straight arrow 30, on and along an elongate carriage rail 32 which is suitably anchored to frame 22. During a printing operation, carriage 28, which (as illustrated) carries four printheads, or pens, 34, 36, 38, 40, moves back and forth over a printing zone shown generally at 42 disposed immediately beneath the printheads. It is through zone 42 that different appropriate kinds of print media travel, generally along a path which is partially illustrated by a dash-double-dot line 44 in FIG. 1, during a printing operation.

Printer 20 includes an appropriate controller (not specifically illustrated) which receives instructions from a suitably connected host device, such as a computer (also not specifically shown). During a printing operation, carriage 28, with its supported printheads, is typically disposed generally over printing zone 42. However, at the end of a printing operation, or perhaps at intervals during a lengthy printing operation, the carriage may be returned along rail 32 to what is referred to as a home, or servicing station, shown generally at 46 in FIG. 1. It is within servicing station 46 that various maintenance and storage tasks typically are carried out, such as cleaning of the ink discharge (or exit) faces of the printheads. Other maintenance tasks may also be carried out in station 46, but these other tasks do not form part of the implementation and practice of the present embodiment of the invention, and thus are not detailed herein.

Still with general reference to what is illustrated in FIG. 1, ink solvent delivery apparatus 26 is shown mounted adjacent the lower reaches of station 46. As indicated, ink solvent delivery apparatus 26 includes an ink reservoir portion, shown generally at 48, which typically is mounted on printer frame 22 in service station 46. A soldier course, or group, of upwardly extending flexible and resilient wipers, also referred to herein as cleaners, are shown generally at 50. These wipers are mounted for reciprocation, as indicated by double-ended straight arrow 52 in FIG. 1, and are formed of a flexible, resilient, non-abrasive, elastomeric material such as nitrile rubber, ethylene polypropylene diene monomer, or other known, comparable materials.

In general terms, during an ink-solvent cleaning operation, wipers 50 are moved into contact with dispensing structure (or outlet structure) that is associated operatively with the reservoir portion of the ink solvent delivery apparatus under which circumstance the wipers pick up an appropriate wetting of solvent. After solvent wetting, the wipers typically wipe against the exposed undersurfaces of the printheads by reciprocating beneath these printheads under the control of the printer controller. This, of course, is done at a point in time when carriage 28 has moved the printheads into servicing station 46.

Specific structural arrangements proposed according to two different embodiments of the present invention provide different ways of delivering and dispensing ink solvent to cleaners, such as wipers 50. A first one of these embodiments will now be described in greater detail with reference to FIGS. 2–6, inclusive, taken along with FIG. 1.

Included in ink solvent delivery apparatus 26 herein are four reservoir (supply) structures 54, 56, 58, 60 which sit as individual units in an overall reservoir housing 62. Reservoir structures 54, 56, 58, 60 are specifically associated herein with printheads 34, 36, 38, 40, respectively. These reservoir structures typically possess the angular configuration evident in FIGS. 3–6, inclusive. Because all of these reservoir structures are substantially similar in construction, only reservoir structure 60 will be described in detail. This reservoir structure, which is also referred to as a reservoir means, is associated in the depicted embodiment with a pair of the group of wipers designated 50, with this pair including two wipers, 63, 64. As will be explained, reservoir structure 60 is configured to deliver liquid ink solvent to wiper 63. These wipers are assigned the task, so-to-speak, of cleaning ink residue from the underside of printhead 40 (see especially FIG. 3).

While description will now continue principally with reference to reservoir structure 60, wipers 63, 64, and printhead 40, it should be understood that the other three reservoir structures provided in apparatus 26, along with like pairs of wipers in wiper group 50, play specific roles in ink-solvent cleaning of the other three printheads 34, 36, 38. The relative positions of the reservoir structures in structure 26, in relation to the wipers in group 50, are such that, when carriage 28 has positioned the printheads appropriately within servicing station 46, the respective associated reservoir structures, wipers and printheads are disposed in appropriate lateral alignment with one another.

As indicated, reservoir structures 54, 56, 58, 60 may be formed in a unitary molded plastic body, shown generally at 66. Typically, the plastic material employed for the reservoir structures is a noryl or polypropylene material. The specific locations within this body which form the specific reservoir structures that are identified by reference numbers 54, 56, 58, 60 may be divided by molded divider walls 68, 70, 72. These divider walls may be spaced and substantially parallel to one another, and may be interposed parallel outer side walls 74, 76 (see particularly FIGS. 2, 4 and 6).

Cooperating with all of these so-far mentioned walls to define the respective inside chambers that characterize reservoir structures 54, 56, 58, 60 are a rear wall 78, a front wall 80 and a base wall 82. These rear, front and base walls typically extend the full lateral width of the overall reservoir structure. Base wall 82 and front wall 80 may be configured so that they furnish an exposed, elongate, somewhat angularly disposed, open front region in each of the chambers in the reservoir structures. This open region is indicated generally at 84 in FIGS. 3–5, inclusive. A separate, vented lid component 86 typically closes off the upper part of the overall reservoir structure.

Figure 4:
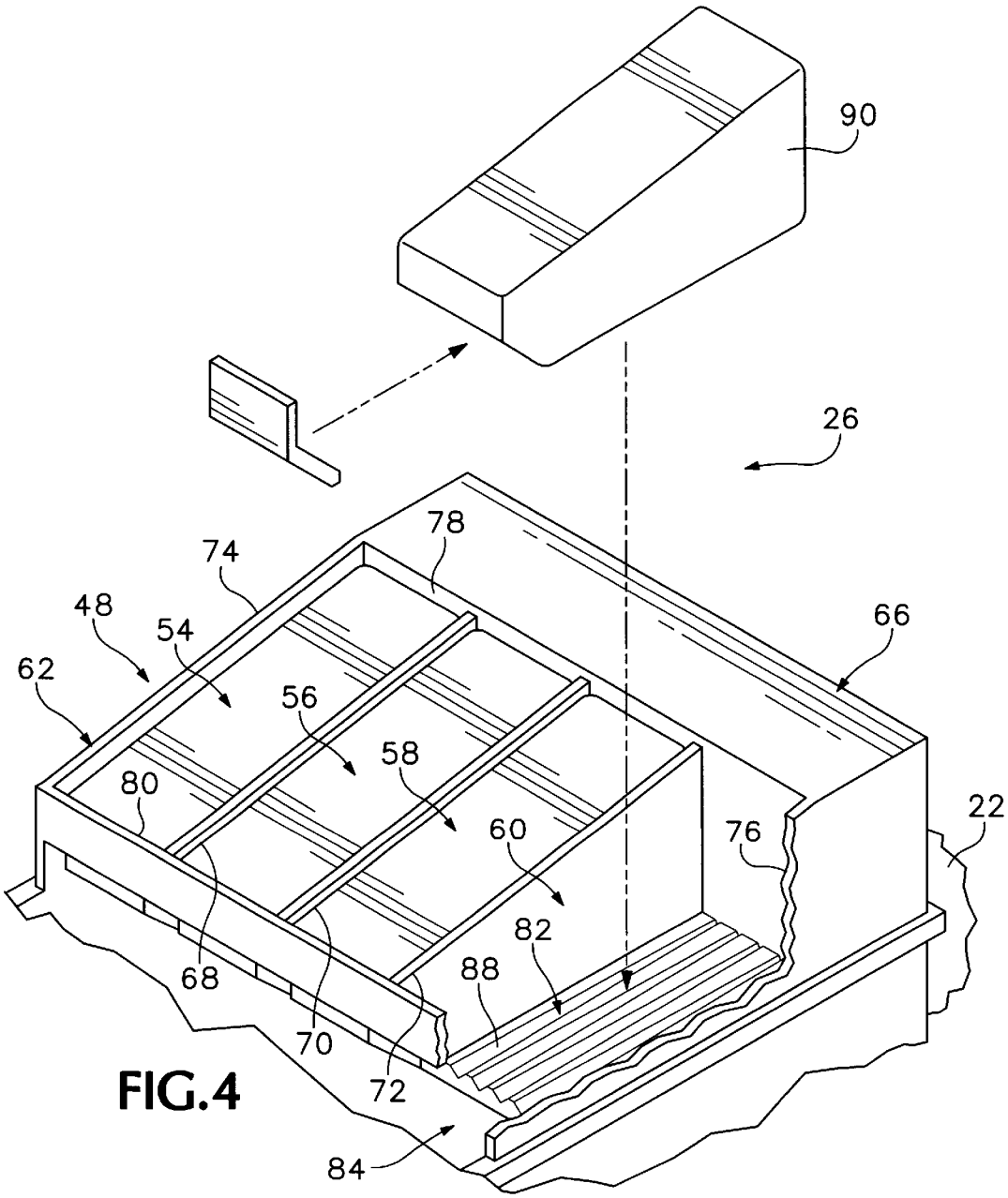
FIG. 4 is a partially exploded, fragmentary, isometric view of a portion of the ink solvent delivery apparatus pictured in FIGS. 2 and 3.
Figure 5:
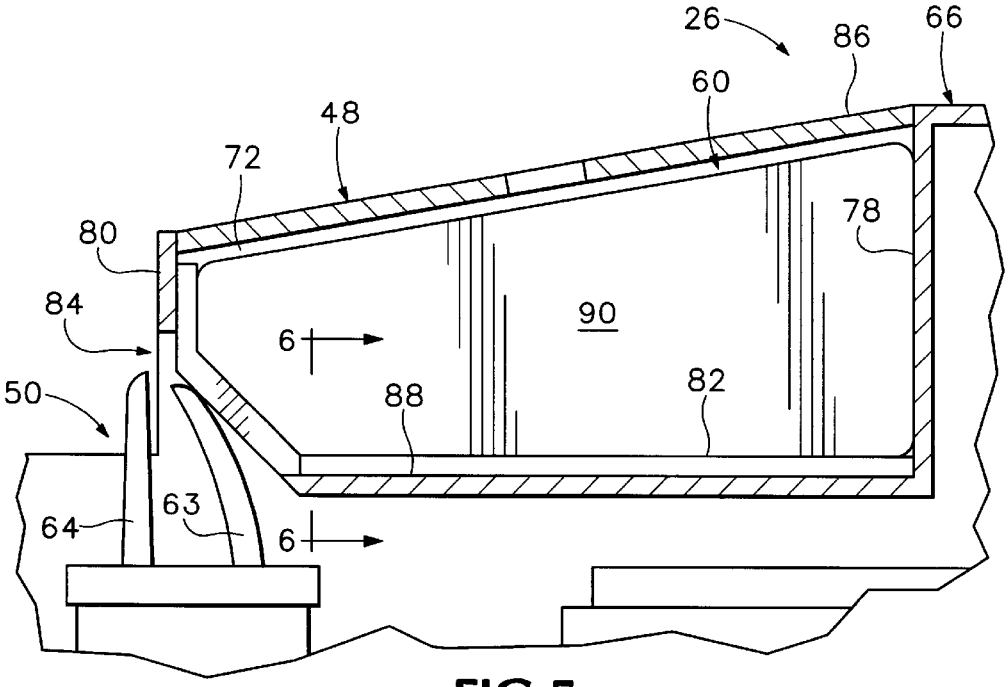
FIG. 5 is a fragmentary side elevation view of a portion of the ink solvent delivery apparatus illustrated in a condition wherein a printhead wiper/cleaner is receiving ink solvent from a dispensing pad.
Figure 6:
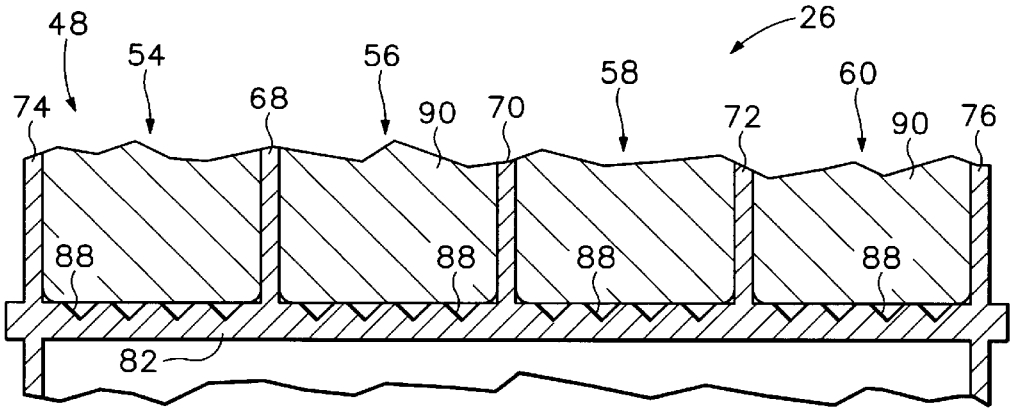
FIG. 6 is a fragmentary, cross-sectional view taken generally along lines 6—6 in FIG. 5.

As best shown in FIGS. 4 and 6, the chamber of reservoir structure 60 typically is exposed to plural elongate, liquid conveyance, capillary grooves, or channels, 88 which are formed in the upwardly-facing surface of base wall 82. These channels are also referred to herein as capillary force structure and as liquid conveyance structure. The open tops of the channels are referred to as liquid reception portions of the channels. As can be seen particularly in FIGS. 4 and 6, these capillary channels have a somewhat triangular cross-section whose area becomes greater as one progresses forward toward front wall 80 (toward the lower left along the lengths of the channels as seen in FIG. 4). The channels typically extend the full length of the reservoir chamber. The "near" ends of the channels are referred to herein also as outlet or discharge ends. Channels 88 herein have a width of about 0.5 millimeter at their narrow ends, a width of about 1.5 millimeters at their wide ends, and a uniform central depth of about 0.1 millimeter.

Seated in, and closely fitted in, each of the reservoir chambers may be a reservoir block, or porous reservoir body, such as block 90 in the chamber in structure 60. These blocks, shaped as shown in FIGS. 3–6, inclusive, may be made of a suitable porous material which functions as a capillary holder for a fill of liquid ink solvent. The bottoms of these blocks may rest on the upper surface of base wall 82, and lie above, fully along and closely adjacent the open tops of the capillary channels.

This arrangement creates plural, capillary interaction fluid paths between the blocks and the channels in a manner whereby surface-energy characteristics of the channels collaborates with surface-tension characteristics of the ink solvent to fill the channels with what is referred to herein as a liquid continuum of ink solvent. This condition, namely, the creation and existence of such a liquid continuum, plays a role in the advantageous behavior of the ink solvent delivery apparatus. More specifically, it assures that substantially all deliverable and dispensable solvent which is initially made available within the body of the porous reservoir blocks is utilized, with no appreciable amount of solvent left stranded within the reservoir chambers.

Appropriately fitted in spanning relationships relative to the open regions of the reservoir chambers (such as previously-mentioned open region 84 in the chamber in reservoir structure 60), may be an angular, porous, capillary-material dispensing pad. This pad, or pads, which is also referred to herein as dispensing structure or outlet structure, acts as a capillary receptor component. The pad thus may function as an applicator wick, and may employ capillary action to draw ink solvent from the nearby ends of the capillary channels as viewed in FIG. 4. The pad also may function, at their outer surfaces, to deliver ink solvent to the previously-mentioned wipers. The dispensing pad may be made of a material such as a polyurethane foam, a suited polyethylene, or other known functionally similar materials.

In this first embodiment of the invention, a reliable and stable liquid continuum of deliverable ink solvent will be understood to extend unbroken from the blocks within the reservoir chambers, through the full lengths of the capillary channels, and to the exposed outside surfaces of the dispensing pads. Substantially all available solvent thus may be used without the development of any substantial stranded remnants.

Figure 7:
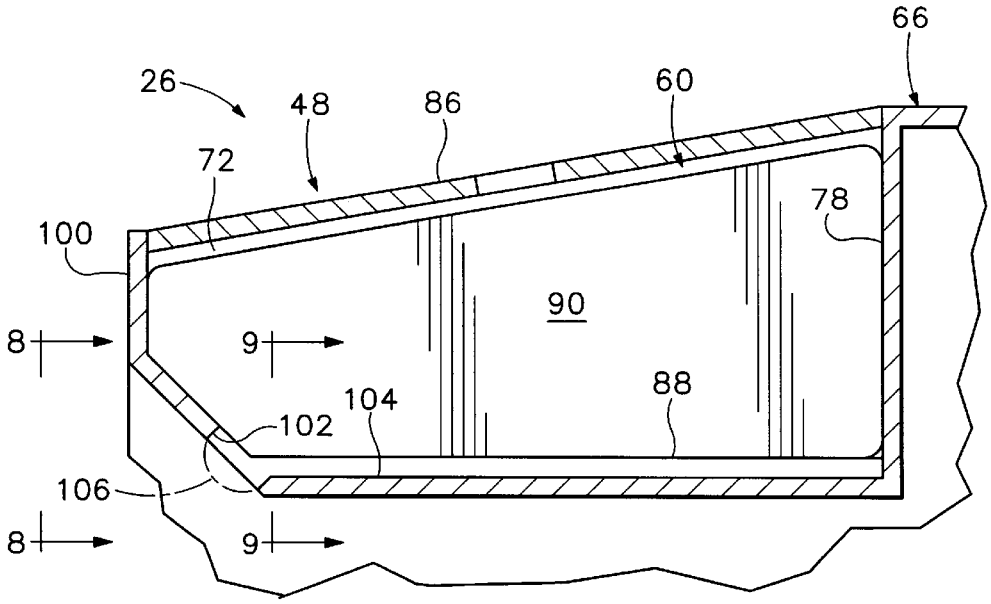
FIG. 7 is a fragmentary side elevation of an ink solvent delivery apparatus constructed in accordance another embodiment of the present invention.
Figure 8:
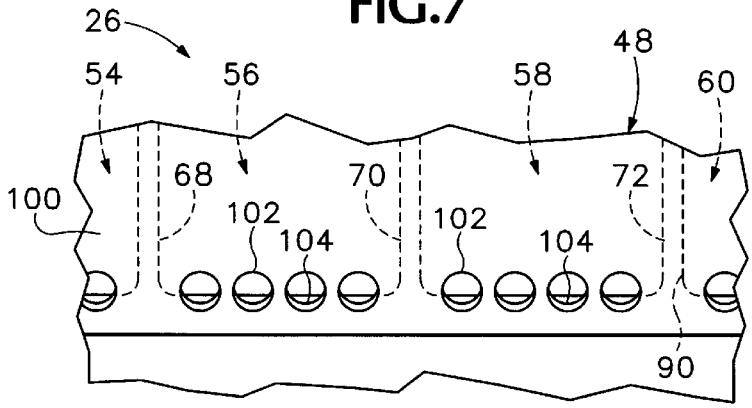
FIGS. 8 and 9 are fragmentary details taken generally along lines 8—8 and 9—9, respectively, in FIG. 7.
Figure 9:
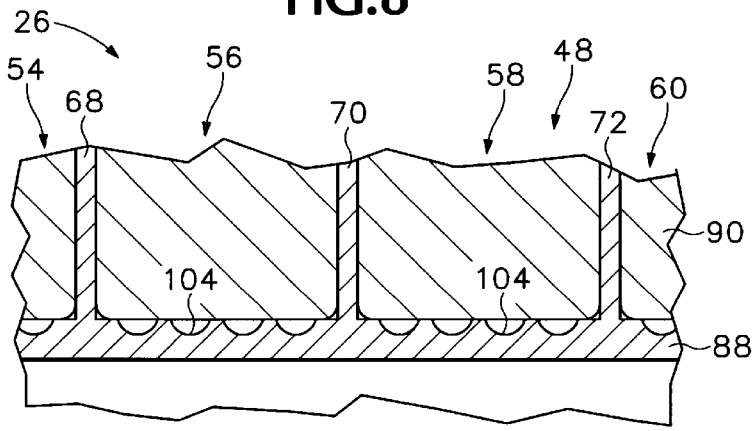

FIGS. 7, 8 and 9 illustrate another form of the invention, wherein like components previously discussed herein are designated with the same respective reference numerals. In this embodiment of the invention, the reservoir structure chambers have their front areas almost completely closed off by molded body structure, which structure may include a downwardly angularly-facing orifice plate portion, such as plate portion 100 shown in FIGS. 7 and 8. This plate portion includes plural dispensing through-bores, or orifices, one for the outlet end of each capillary channel. These orifices constitute dispensing structure, or outlet structure, in this embodiment of the invention. Several of these orifices (in plate portion 100) are shown at 102 in association with each chamber of FIGS. 7 and 8. These outlet orifices are referred to collectively herein as dispensing orifice structures which open to the outlet face of the reservoir plate portion 100.

In the invention embodiment now being described, the capillary channels (see 104 in FIGS. 7–9, inclusive) are configured somewhat differently in relation to previously-discussed channels 88. Channels 104 each have a generally semicircular cross-section which tapers toward the rear of the channels. It will be appreciated, of course, that the semi-circular channels now described may be used in the previous embodiment, and vice versa. Furthermore, it will be appreciated that a elongate conveyance structure fluidly connecting the reservoir structure to the dispensing structure, and having along its length a surfaceenergy characteristic which conveys a flowable continuum of ink solvent to the dispensing structure at least partially via surface-energy phenomena similarly may be employed.

As was described above, reservoir blocks, such as block 90, containing a charge of liquid ink solvent, are fitted into the chambers in the reservoir structures and the capillary channels underlying these blocks function in relation to these blocks in the same manner discussed earlier. However, in this embodiment of the invention, liquid solvent is presented to the cleaning wipers in the form of plural, outwardly bulging and projecting, convex meniscuses of solvent. One such meniscus is pictured in dash-dot lines at 106 in FIG. 7.

During a cleaning operating involving this embodiment of the structure of the present invention, the cleaning wipers comes into contact with the associated orifices in the orifice plates in the reservoir structures, and thereby contact the projecting meniscuses of ink solvent. Such contact causes a flow of solvent into the wipers for collection thereby, and for a subsequent printhead cleaning operation.

A printhead-servicing system thus is provided, as exemplified by the above-described embodiments, for servicing a printhead in an ink-utilizing printing device. The system may be considered to include a reservoir structure including a chamber for holding a supply of dispensable liquid ink solvent, an elongate capillary channel structure disposed in liquid communication with the chamber of the reservoir structure and having an outlet end operable to draw ink solvent from the ink supply held within the chamber of the reservoir structure and to convey the ink solvent to the outlet end of the capillary channel structure, a liquid-dispensing outlet structure disposed in liquid communication with the outlet end of the capillary channel structure, and adapted to receive ink solvent conveyed to the outlet end of the capillary channel structure and to establish a dispensable presentation of such ink solvent, and a wiper/cleaner structure moveable in the printing device relative both to the outlet structure and to the printhead, and contactable with both, respectively, to collect solvent presented by the outlet structure and to apply such collected solvent in a cleaning engagement with the printhead.

The printhead-servicing system may employ outlet structure in the form of a porous dispensing pad having an exposed porous outlet surface configured to present solvent for collection by the wiper/cleaner structure. Alternatively, the outlet structure may take the form of an orifice plate including at least one orifice configured to present solvent for collection by the wiper/cleaner structure. Typically, the capillary channel structure is configured to produce a flowable continuum of ink solvent terminating adjacent the orifice plate to produce an exposed convex meniscus of ink solvent poised for collection by the wiper/cleaner structure.

Liquid ink solvent may thus be delivered to a printhead cleaner in a printing device via a method involving establishing a flowable liquid continuum of ink solvent from a reservoir supply of liquid ink solvent in the printer. The flowable continuum of such solvent may be made to extend from the supply via surface-energy characteristics in reservoir structure that is engaged along the continuum with solvent present in the continuum. At a location spaced from the solvent supply in the reservoir, liquid ink solvent in the continuum may be presented to a receptor component, and through that receptor component, liquid solvent may be presented to the printhead cleaner for cleaning a printhead. The receptor component may take the form of a porous dispensing pad having an exposed porous outlet surface configured to present solvent for collection by the printhead cleaner. Alternatively, the receptor component may take the form of an orifice plate including at least one orifice, the flowable continuum of solvent terminating adjacent the orifice with an exposed convex meniscus of solvent poised for collection by the printhead cleaner. Such flowable continuum may be established via capillary channel structure including one or more channels, each with a cross-sectional area which increases progressing toward the receptor component.

While the invention has been particularly shown and described with reference to the foregoing embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. Where the claims recite "a" or "a first" element or the equivalent thereof, such claims should be understood to include incorporation of one or more such elements, neither requiring nor excluding two or more such elements.

What is claimed is:

1. Apparatus for delivering ink solvent to a printhead in a printing device, the apparatus comprising:

reservoir structure configured to hold ink solvent, a dispensing structure configured to dispense ink solvent drawn from the reservoir structure; and elongate conveyance structure fluidly connecting the reservoir structure to the dispensing structure, and having along its length a surface-energy characteristic which conveys a flowable continuum of ink solvent to the dispensing structure at least partially via surface-energy phenomena.

2. The apparatus of claim 1, wherein the conveyance structure includes at least one elongate capillary channel formed in the reservoir structure and having an end disposed adjacent and communicating with the dispensing structure.

3. The apparatus of claim 1, wherein the dispensing structure includes at least one exposed-outlet orifice which coacts with the conveyance structure to create an outwardly-bulging convex meniscus of ink solvent which meniscus forms part of the flowable continuum of ink solvent.

4. The apparatus of claim 1, wherein the dispensing structure includes a liquid-permeable dispensing pad having an exposed porous outlet surface.

5. An ink solvent delivery apparatus comprising:

reservoir structure configured to hold ink solvent, dispensing structure configured to dispense ink solvent drawn from the reservoir structure; and conveyance structure including at least one elongate capillary channel formed in the reservoir structure to convey ink solvent from the reservoir structure to the dispensing structure.

6. The ink solvent delivery apparatus of claim 5, wherein the conveyance structure is configured, under circumstances with ink solvent present in the reservoir structure, to establish a flowable continuum of such ink solvent extending between the reservoir structure and the dispensing structure.

7. The ink solvent delivery apparatus of claim 6, wherein the dispensing structure includes at least one orifice, the flowable continuum of ink solvent terminating adjacent the orifice with an exposed convex meniscus of ink solvent poised for collection.

8. The ink solvent delivery apparatus of claim 5, wherein the dispensing structure includes a liquid-permeable dispensing pad having an exposed porous outlet surface.

9. The ink solvent delivery apparatus of claim 5, wherein the capillary channel possesses a cross-sectional area which expands progressing along the capillary channel toward the dispensing structure.

10. The ink solvent delivery apparatus of claim 5, wherein the conveyance structure includes plural capillary channels, each extending along the reservoir structure to the dispensing structure.

11. The ink solvent delivery apparatus of claim 5, wherein the reservoir structure includes a porous reservoir body impregnated with ink solvent.

12. An ink solvent delivery apparatus comprising:

reservoir means for holding ink solvent;

conveyance means for conveying a flowable continuum of ink solvent along an internal surface of the reservoir means via a varying surface-energy characteristic of such reservoir means; and outlet means in fluid communication with the conveyance means for releasing ink solvent from the reservoir means.

13. The ink solvent delivery apparatus of claim 12, wherein the conveyance means includes elongate capillary channels formed in the reservoir means.

14. The ink solvent delivery apparatus of claim 13, wherein the capillary channels possess cross-sectional areas which expand progressing along the capillary channel toward the outlet means.

15. The ink solvent delivery apparatus of claim 12, wherein the outlet means includes an applicator wick in fluid communication with the conveyance means.

16. The ink solvent delivery apparatus of claim 12, wherein the outlet means includes at least one orifice in fluid communication with the conveyance means.

17. The ink solvent delivery apparatus of claim 16, wherein the flowable continuum of ink solvent terminates adjacent the orifice with an exposed convex meniscus of ink solvent poised for collection.

18. The ink solvent delivery apparatus of claim 12, wherein the reservoir means includes a porous reservoir body impregnated with ink solvent.

19. A printing device comprising:

a printhead;

an ink solvent delivery apparatus including a reservoir configured to hold ink solvent and an outlet structure configured to release ink solvent from the reservoir, the ink solvent dispenser employing elongate capillary channel structure formed in the reservoir to deliver a flowable continuum of ink solvent to the outlet structure; and a printhead cleaner mounted for travel between positions closely adjacent the outlet structure of the ink solvent delivery apparatus and closely adjacent the printhead to deliver ink solvent from the ink solvent delivery apparatus to the printhead.

20. The printing device of claim 19, wherein the outlet structure includes at least one orifice, the flowable continuum of ink solvent terminating adjacent the orifice with an exposed convex meniscus of ink solvent poised for collection by the printhead cleaner.

21. The printing device of claim 19, wherein the outlet structure includes a liquid-permeable dispensing pad having an exposed porous outlet surface configured to present ink solvent for collection by the printhead cleaner.

22. The printing device of claim 19, wherein the capillary channel structure includes plural channels, each with a cross-sectional area which expands progressing toward the outlet structure.

23. The printing device of claim 19, wherein the reservoir includes a porous reservoir body impregnated with ink solvent.

24. A printhead-servicing system for servicing a printhead in an ink-utilizing printing device, the system comprising:

reservoir structure including a chamber for holding a supply of dispensable liquid ink solvent;

elongate capillary channel structure disposed in liquid communication with the chamber of the reservoir structure and having an outlet end operable to draw ink solvent from the ink supply held within the chamber of the reservoir structure and to convey the ink solvent to the outlet end of the capillary channel structure;

liquid-dispensing outlet structure disposed in liquid communication with the outlet end of the capillary channel structure, and adapted to receive ink solvent conveyed to the outlet end of the capillary channel structure and to establish a dispensable presentation of such ink solvent; and wiper/cleaner structure moveable in the printing device relative both to the outlet structure and to the printhead, and contactable with both, respectively, to collect solvent presented by the outlet structure and to apply such collected solvent in a cleaning engagement with the printhead.

25. The system of claim 24, wherein the outlet structure takes the form of a porous dispensing pad having an exposed porous outlet surface configured to present solvent for collection by the wiper/cleaner structure.

26. The system of claim 24, wherein the outlet structure takes the form of an orifice plate including at least one orifice configured to present solvent for collection by the wiper/cleaner structure.

27. The system of claim 24, wherein capillary channel structure is configured to produce a flowable continuum of ink solvent terminating adjacent the orifice plate to produce an exposed convex meniscus of ink solvent poised for collection by the wiper/cleaner structure.

28. The system of claim 24, wherein the supply of liquid ink solvent resides in a block of porous material placeable within the chamber.

29. A method of delivering liquid ink solvent to a printhead cleaner in a printing device having an ink-utilizing printhead, the method comprising:

from a reservoir supply of liquid ink solvent in the printer, establishing an elongate, flowable liquid continuum of such solvent extending from the supply via surface-energy characteristics in reservoir structure that is engaged along the continuum with solvent present in the continuum;

at a location spaced from the solvent supply in the reservoir, presenting liquid ink solvent in the continuum to a receptor component; and through that receptor component, presenting liquid solvent to the printhead cleaner.

30. The method of claim 29, wherein the receptor component takes the form of a porous dispensing pad having an exposed porous outlet surface configured to present solvent for collection by the printhead cleaner.

31. The method of claim 29, wherein the receptor component takes the form of an orifice plate including at least one orifice, the flowable continuum of solvent terminating adjacent the orifice with an exposed convex meniscus of solvent poised for collection by the printhead cleaner.

32. The method of claim 29, wherein establishing a flowable continuum of solvent is achieved via capillary channel structure including one or more channels, each with a cross-sectional area which increases progressing toward the receptor component.

* * * * *